US005459893A

United States Patent [19]

Walters, III

[11] Patent Number: 5,459,893

[45] Date of Patent: Oct. 24, 1995

[54] TV CANOPY FOR BED

[75] Inventor: Guy A. Walters, III, High Point, N.C.

[73] Assignee: Thomasville Furnature, Inc., Thomasville, N.C.

[21] Appl. No.: 178,919

[22] Filed: Jan. 7, 1994

[51] Int. Cl.[6] ..... A47C 29/00

[52] U.S. Cl. ..... 5/414; 5/658; 312/7.2

[58] Field of Search ..... 5/414, 658; 312/26, 312/30, 7.2

[56] References Cited

U.S. PATENT DOCUMENTS

| | | | |
|---|---|---|---|
| 2,805,411 | 9/1957 | Rose | 312/7.2 |
| 4,410,158 | 10/1983 | Maffei | 5/658 |
| 4,607,401 | 8/1986 | Sisson | 5/658 |
| 4,903,353 | 2/1990 | Park | 5/414 |
| 5,054,139 | 10/1991 | Jones | 5/414 |
| 5,181,771 | 1/1993 | Robak et al. | 312/7.2 |

*Primary Examiner*—Michael J. Milano
*Attorney, Agent, or Firm*—Rhodes, Coates & Bennett

[57] ABSTRACT

A canopy, for use with a bed, comprising a horizontal platform having an opening, a plurality of posts that support the horizontal platform in a location above the bed, and a supporting apparatus located within the opening of the platform and attached to the platform. The supporting apparatus has the capability of supporting a conventional television set, which has a front screen area, at an acute viewing angle so that the front screen area is visually assessable to a viewer who is reclining or sitting on the bed. When a conventional television is mounted in the supporting apparatus, a portion of the television will be recessed up within the horizontal platform, but still be visually assessable to the viewer.

26 Claims, 3 Drawing Sheets

TV CANOPY FOR BED

FIELD OF THE INVENTION

The present invention relates generally to bed canopies, and, more particularly, to an attractive but functional bed canopy that accommodates a television.

BACKGROUND OF THE INVENTION

At the end of the workday, most in our society are physically exhausted. Even those with relatively sedentary occupations often supplement their daily routine with vigorous physical exercise. Physical exhaustion, however, does not always equal to mental exhaustion, and many choose to end the day by reclining and watching television. The added convenience of turning off the television and falling immediately to sleep lead many to watching television as the last activity before retiring for the night.

Typically, the television is placed near the bed either on a television stand or on a nearby piece of furniture. In either location, the person watching television has little choice on how to position herself. She must either sit up in bed, with her legs either stretched straight out or bent, or she must partially recline and place or prop her head up at an uncomfortable angle in order to view the television. Either position, in addition to being uncomfortable, can create or aggravate back and neck pain. Consequently, physicians and orthopaedic doctors recommend that these positions be avoided. Thus, there is a need for bedroom furniture to accommodate a television in an easy-to-view location.

Moreover, there also exists a strong need to provide a functional and comfortable environment for persons who are confined at home to their beds for illness or recuperation. An attractive piece of bedroom furniture that fits within or complements a room's decor creates a pleasing, non-hospital room environment. Having the added convenience of comfortably viewing television or pre-recorded videotapes while being confined to bed will ease and possibly shorten the person's recovery.

Previous attempts to design a bed/television combination have not succeeded in meeting the needs of consumers. Examples of known devices include the cocoon-like modules of U.S. Pat. Nos. 4,395,785 and 4,505,078; the retrofit, cantilevered frames of U.S. Pat. Nos. 4,410,158 and 5,009,379; and the cumbersome, complex structures of U.S. Pat. Nos. 4,903,353, 5,054,139 and 5,165,126.

The purpose of this invention, therefore, is to provide a lasting piece of fine bedroom furniture that allows a person to comfortably view a television while reclining. For many, the optimum angle for viewing a television while reclining results only if the television is elevated and angled towards the viewer so that uncomfortable or protracted neck and back positions can be avoided.

SUMMARY OF THE INVENTION

The present invention is directed to an improved canopy for a bed where the canopy comprises a horizontal platform having an opening; a plurality of posts that support the horizontal platform in a location above the bed; and a supporting apparatus located within the opening of the platform and attached to the platform. The supporting apparatus has the capability of supporting a conventional television set, which has a front screen area, at an acute viewing angle so that the front screen area is visually assessable to a viewer who is reclining or sitting on the bed. When a conventional television is mounted in the supporting apparatus, a portion of the television will be recessed up within the horizontal platform, but still be visually assessable to the viewer.

Accordingly, one aspect of the present invention is to provide an aesthetically pleasing and functional bed canopy that accommodates a television that can be viewed from the bed.

Another aspect of the present invention is to provide a permanent piece of furniture that combines comfort, function, convenience and appearance.

Still another aspect of the present invention is to provide a pre-wired TV canopy bed that will allow the user to quickly and easily install, operate and view a television set.

These and other aspects of the present invention will become apparent to those skilled in the art after a reading of the following description of the preferred embodiments when considered with the drawings.

DESCRIPTION OF THE PREFERRED EMBODIMENTS

The drawings are for the purpose of describing a preferred embodiment of the invention and are not intended to limit the present invention.

Figure 1:
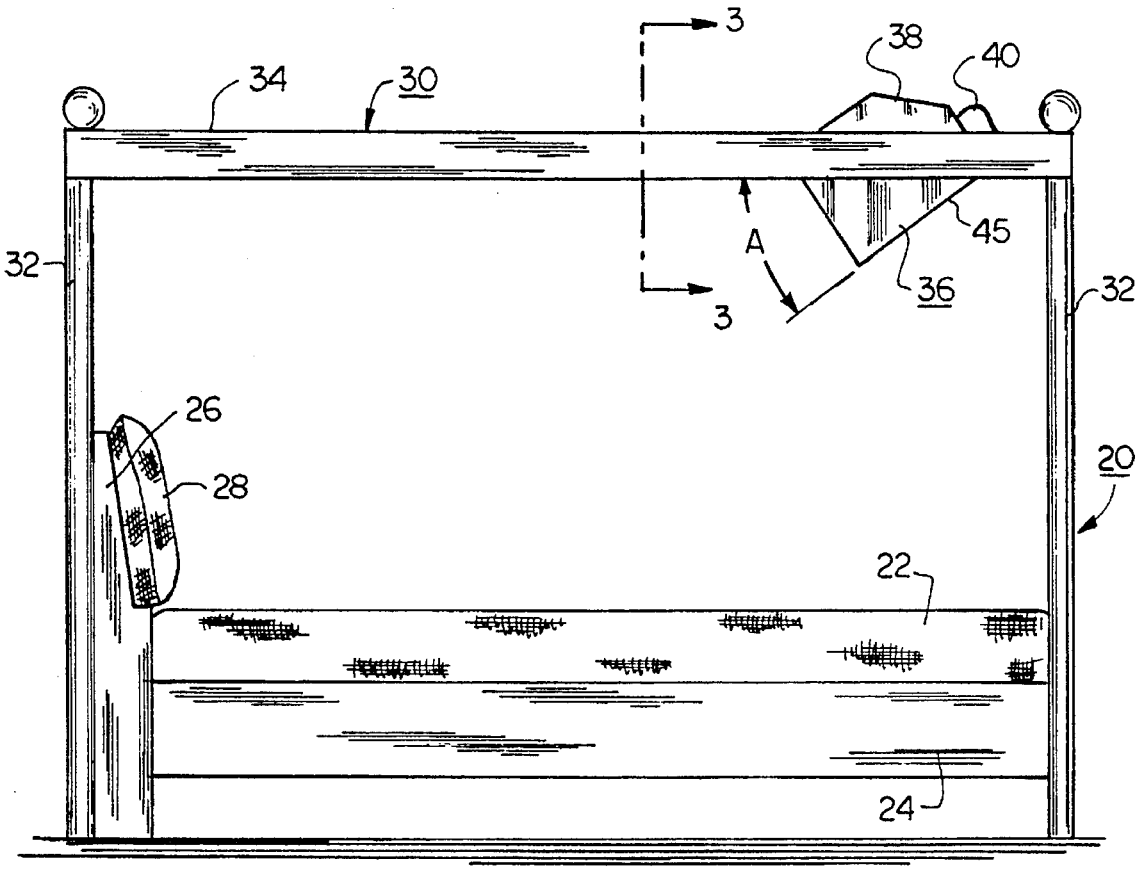
FIG. 1 is a side elevation view of a TV canopy bed.

FIG. 1 depicts a conventional four-corner post bed 20. The bed is comprised of a box springs (not shown) and a mattress 22. Lower side rails 24 substantially surround the lower periphery of the bed. A headboard frame 26 is located at the head of the bed and is sized to accommodate at least one cushion 28.

A canopy 30 is situated above the bed, supported by four posts 32. The posts 32 also support the lower side rails 24, which in turn support the box springs (not shown) and mattress 22. Upper side rails 34 substantially surround the upper periphery of the bed, and form the canopy 30.

A supporting apparatus 36 is attached to the canopy 30, and is sized and inclined so as to support a conventional television set 38. Transmission wiring 40 is provided within the canopy so that a video, audio and power source can be provided to the television. When a conventional television 38 is supported in the canopy, the television will be inclined at an acute viewing angle A. The viewing angle should be such as to provide a comfortable and appropriate angle for a person who is sitting or reclining on the bed to watch television. Preferably the angle should be between 15 and 50 degrees, with the preferred embodiment found to be 33 degrees. References herein to angles of various inclined surfaces refer to the angle measured from horizontal.

Figure 2:
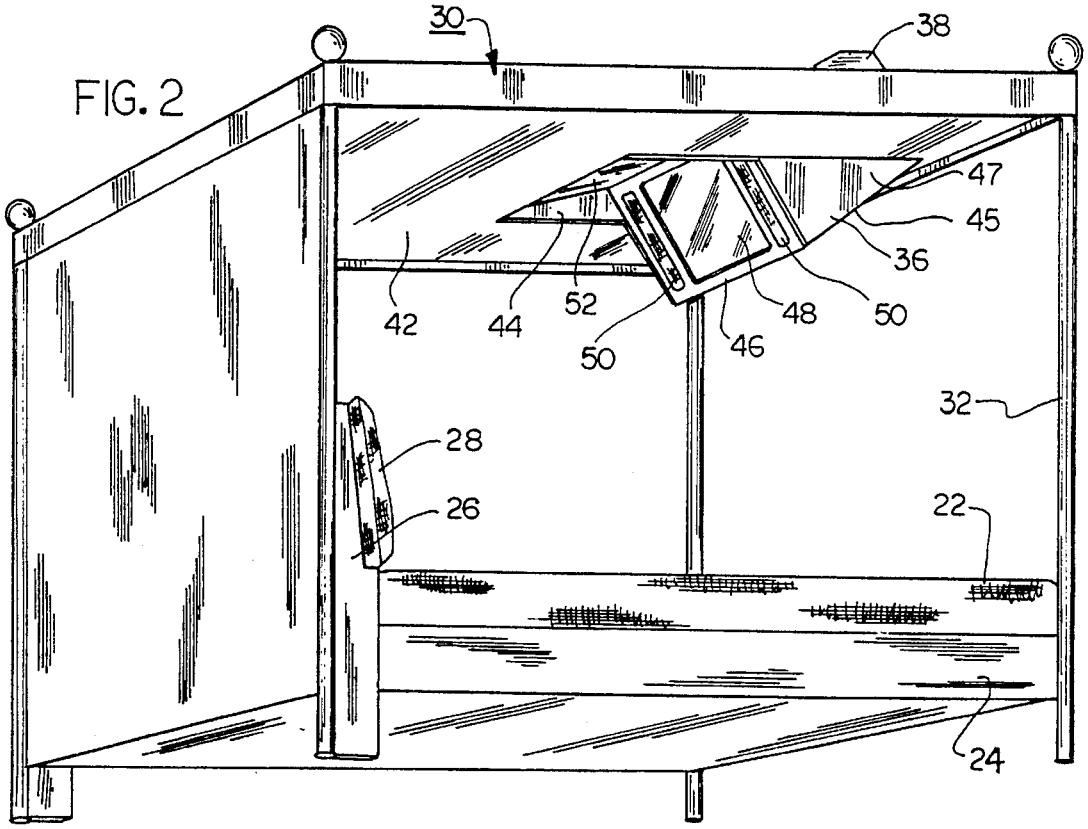
FIG. 2 is a perspective view thereof.

FIG. 2 depicts a perspective view of a TV canopy bed. The canopy 30 is comprised of upper side rails 34 and a horizontal platform 42. The horizontal platform contains an opening 44, wherein the supporting apparatus 36 is placed.

The supporting apparatus 36 is comprised of a shelf 45, side walls 47, and front wall 46. The front wall 46 has a transparent section 48 and at least one sound transmitting section 50. The transparent section 48 is placed so that a front viewing area of the conventional television 38 can be seen by a person on the bed. The sound transmitting section allows the television to be heard by the person on the bed. Of course, both the transparent section and sound transmitting section can be completely open areas, or can be manufactured of material with video and audio transmitting capabilities, respectively.

Also depicted in FIG. 2 is a recessed planar member 52 that is located parallel to the shelf 45 and within the opening 44. The recessed planar member 52 extends from the horizontal platform to the top edge of the front wall 46, and allows the person on the bed to fully view the transparent section 48 of the front wall. This configuration provides an aesthetically pleasing appearance and functions to ensure that the television can easily be viewed when the television is inclined at the preferred viewing angle.

Figure 3:
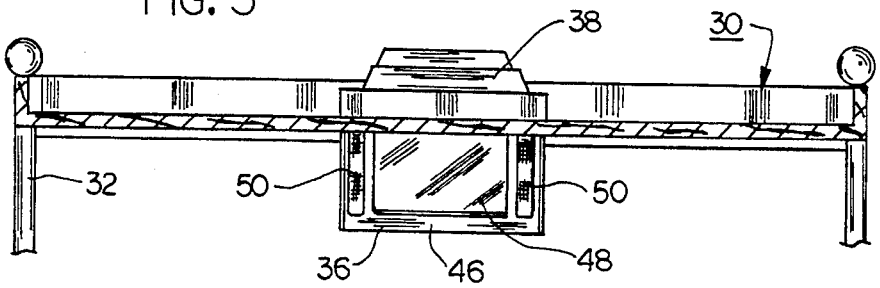
FIG. 3 is a partial sectional view taken along line 3—3 in FIG. 1.
Figure 4:
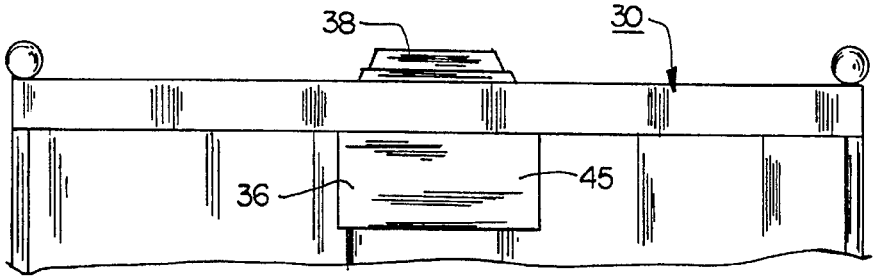
FIG. 4 is a rear elevation view thereof.

FIGS. 3 and 4 depict a front and rear elevation view, respectively, of the canopy 30. The front wall 46 of the supporting apparatus is shown in FIG. 3, as are the transparent section 48 and at least one sound transmitting section 50. The inclined shelf 45 is depicted in FIG. 4.

Figure 5:
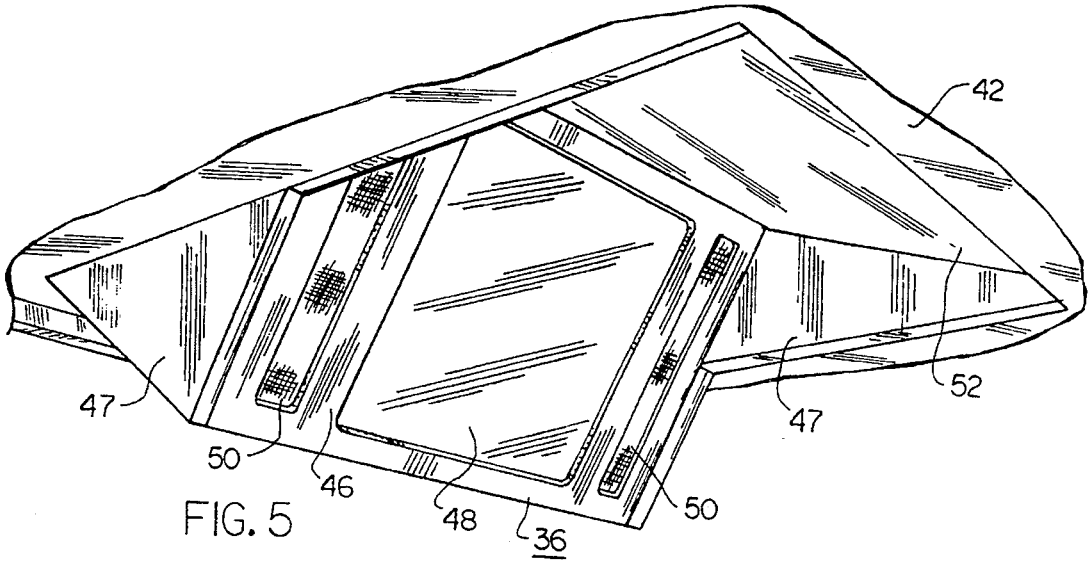
FIG. 5 is a partial perspective view thereof.

FIG. 5 is a partial perspective view of the supporting apparatus 36, containing the front wall 46, side walls 47, the transparent section 48 and at least one sound transmitting section 50. The horizontal platform 42 and recessed planar member 52 are also shown in FIG. 5. The side walls 47 extend to the horizontal platform 42 and help support the recessed planar member 52 to the horizontal platform 42.

Figure 6:
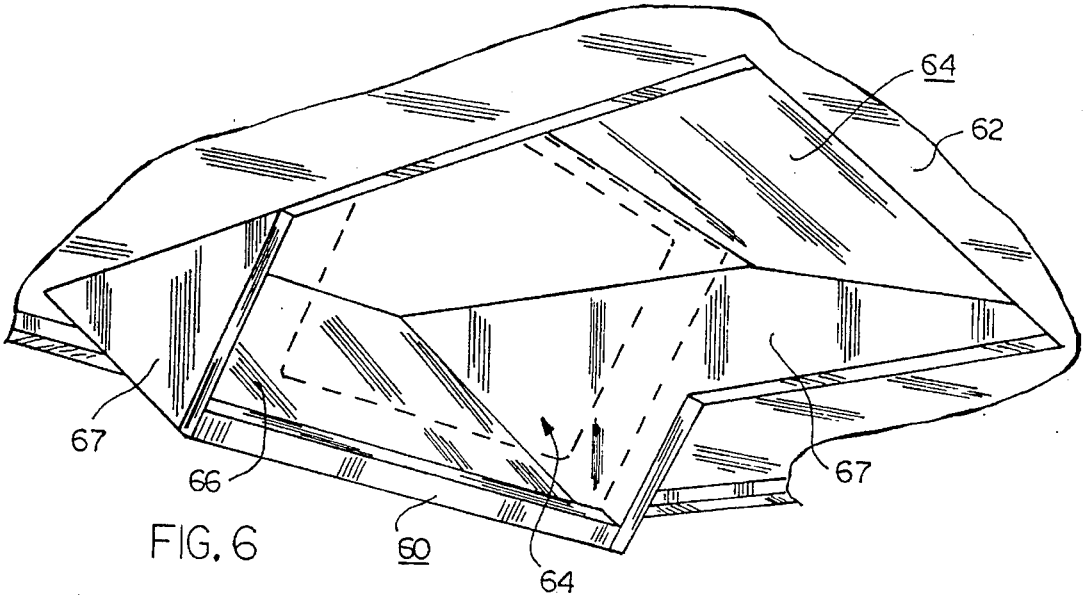
FIG. 6 is a partial perspective view of a second embodiment of a TV canopy for a bed.

FIG. 6 depicts a partial perspective view of another embodiment of this invention. Shown therein is a horizontal platform 62 containing an opening 64. Placed within the opening is a supporting apparatus 60, comprised of a shelf 66 and side walls 67. This embodiment contains an open front area, so that the conventional television, shown in dashed lines in FIG. 6, can easily be seen and heard by a person on the bed.

Conventional attaching or mounting means can be used to for all of the above-cited members, and are well known to those skilled in the industry. Examples include, attaching the members with conventional hardware (e.g., nails, screws, bolts and nuts, rivets, etc.), with bonding means (e.g., glue or other bonding agents or adhesives) or with other conventional joining methods (e.g., tongue and groove) known in the industry. Of course, one-piece molded construction could also be utilized to combine separate elements recited above and still achieve the benefits of this invention.

As is depicted in the above Figures, the supporting apparatus is configured so that a conventional television will be partially "recessed" up within the bed canopy. An appropriate viewing angle can also be provided. The construction and configuration of the supporting apparatus is not limited and could be of the structures discussed above, or be a "U"-shaped bracket extending down from the horizontal platform and within the opening, or any other conventional supporting apparatus for televisions that are well known in the industry.

The preferred embodiment of this invention includes a headboard, canopy frame with inlaid panels in the canopy, 3 reading lights recessed in the canopy and operated by a touch dimmer switch, a TV supporting apparatus, sized to accommodate a conventional 13" television set, and framed bronze beveled glass mirrors in the headboard. The preferred materials are red oak solids and knotty oak veneers, accented with polished brass and gleaming bronzed glass bands. The alternative bed lengths of the preferred embodiment are five feet, six feet and six feet, six inches.

The use of the term "conventional television" used herein means any of the television picture tube, monitor or projection systems available in the marketplace, whether or not additional equipment, e.g., videotape machines, audio amplification or receiving equipment, etc., is included within the television housing.

The beds over which the TV canopy may be placed can be any number of types, including conventional box spring/matters combinations, water beds, platform beds, air mattresses, etc. Further, the size of the bed is not limited, and can be configured for a twin, full, queen, or king size mattress, or other sizes. Although in its preferred embodiment, the post supporting the canopy also serve to support the bed frame itself, this invention is not limited to this embodiment.

The means for restraining the television in the supporting apparatus also is not limited. Depending upon the selected viewing angle for the television, gravity alone may be sufficient to retain a television in its position. In some configurations, such as the embodiment shown in FIG. 6, the shelf 66 can have a front retaining lip 68 to ensure that the television does not slide off the shelf. Suitable mounting or restraining hardware can also be employed where necessary, and will be well known to those skilled in the art.

The above description of the preferred embodiments thus detail many ways in which the present invention can provide its intended purposes. While several preferred embodiments are described in detail hereinabove, it is apparent that various changes might be made without departing from the scope of the invention, which is set forth in the accompanying claims.

I claim:

1. A canopy, for use with a bed, comprising:

(a) a horizontal platform having an opening;

(b) at least one upper side rail surrounding the periphery of said horizontal platform and extending substantially over the entire surface of the bed;

(c) a plurality of vertical posts that support the horizontal platform in a location above the bed; and (d) a supporting apparatus located within the opening of the platform and attached to the platform; the supporting apparatus having the capability of supporting a conventional television set, having a front screen area, at an acute viewing angle so that the front screen area is visually assessable to a viewer who is reclining or sitting on the bed.

2. The canopy according to claim 1, wherein the acute viewing angle is between 15 and 50 degrees.

3. The canopy according to claim 1, wherein the acute viewing angle is 33 degrees.

4. The canopy according to claim 1, wherein:

(a) the supporting apparatus is configured so that when the conventional television is supported thereby, the upper portion of the front screen area extends up beyond the horizontal platform; and (b) the opening is configured as to provide said acute viewing angle.

5. The canopy according to claim 1 that further comprises suitable wiring so that a video, audio and power source can be provided to the television placed within the supporting apparatus.

6. The canopy according to claim 1, wherein the supporting apparatus comprises a shelf, two side walls and a front wall, the shelf being inclined at the acute viewing angle and partially extending down through the opening in the horizontal platform.

7. The canopy according to claim 6, wherein the front wall of the supporting apparatus comprises:

(a) a transparent section so that the conventional television, when placed on the shelf, can be viewed when reclining on the bed; and (b) a sound transmitting section so that the conventional television, when placed on the shelf, can be heard while reclining on the bed.

8. The canopy according to claim 7, wherein the (a) the front wall of the supporting apparatus further comprises a top edge; and (b) the horizontal platform further comprises a recessed planar member located parallel to the shelf and within the opening of the horizontal platform and further extending from the horizontal platform to the top edge of the front wall.

9. A canopy, for use with a bed, comprising:

(a) a horizontal platform having an opening;

(b) at least one upper side rail surrounding the periphery of said horizontal platform and extending substantially over the entire surface of the bed;

(c) a plurality of vertical posts that support the horizontal platform in a location above the bed; and (d) a supporting apparatus located within the opening of the platform and attached to the platform; the supporting apparatus having the capability of supporting a conventional television set, having a front screen area, so that the top of the front screen area is above the horizontal platform and the opening is configured so that the upper portion of the screen is visually accessible to a viewer who is reclining or sitting on the bed.

10. The canopy according to claim 9 that further comprises suitable wiring so that video, audio and a power source can be provided to the television placed on the shelf.

11. The canopy according to claim 9, wherein the supporting apparatus comprises:

(a) a shelf, two side walls, a back wall and a front wall;

(b) the front wall comprising:

(1) a transparent section so that the conventional television, when placed on the shelf, can be viewed when reclining on the bed; and (2) a sound transmitting section so that the conventional television, when placed on the shelf, can be heard while reclining on the bed.

12. A canopy bed comprising:

(a) a bed having a frame, a head board, a mattress and a plurality of posts supporting the frame;

(b) the head board being oriented at a non-vertical angle and being sized to accommodate at least one cushion;

(c) a canopy supported above the bed by the plurality of posts and further comprising:

(1) a horizontal platform having an opening;

(2) a partial enclosure mounted within the opening and defined by a shelf, two side walls, and a front wall; the enclosure sized to allow a conventional television to be placed thereon and oriented so that the television is at an acute viewing angle when measured from the horizontal plane;

(3) the front wall of the enclosure having:

(a) a top edge;

(b) a transparent section so that a television placed on the shelf can be viewed when reclining on the bed; and (c) a sound transmitting section so that a television placed on the shelf can be heard while reclining on the bed;

(4) a recessed planar member located parallel to the shelf and within the opening of the horizontal platform and further extending from the horizontal platform to the top edge of the front wall;

(5) at least one reading light mounted within the horizontal platform;

(6) a plurality of side rails located along substantially the entire periphery of the horizontal platform; and (7) suitable wiring so that a video source, an audio source and a power source can be provided to the television within the enclosure.

13. The canopy according to claim 12, wherein the acute viewing angle is between 15 and 50 degrees.

14. The canopy according to claim 13, wherein the acute viewing angle is 33 degrees.

15. A canopy, for use with a bed, comprising:

(a) a horizontal platform having an opening;

(b) at least one upper side rail surrounding the periphery of said horizontal platform and extending substantially over the entire surface of the bed;

(c) at least three posts that support the horizontal platform in a location above the bed; and (d) a supporting apparatus located within the opening of the platform and attached to the platform; the supporting apparatus having the capability of supporting a conventional television set, having a front screen area, at an acute viewing angle so that the front screen area is visually assessable to a viewer who is reclining or sitting on the bed.

16. The canopy according to claim 15, wherein the acute viewing angle is between 15 and 50 degrees.

17. The canopy according to claim 15, wherein the acute viewing angle is 33 degrees.

18. The canopy according to claim 15, wherein:

(a) the supporting apparatus is configured so that when the conventional television is supported thereby, the upper portion of the front screen area extends up beyond the horizontal platform; and (b) the opening is configured so that the front screen area in its entirety is visually assessable to the viewer who is reclining or sitting on the bed.

19. The canopy according to claim 15 that further comprises suitable wiring so that a video, audio and power source can be provided to the television placed within the supporting apparatus.

20. The canopy according to claim 15, wherein the supporting apparatus comprises a shelf, two side walls and a front wall, the shelf being inclined at the acute viewing angle and partially extending down through the opening in the horizontal platform.

21. The canopy according to claim 20, wherein the front wall of the supporting apparatus comprises:

(a) a transparent section so that the conventional television, when placed on the shelf, can be viewed when reclining on the bed; and (b) a sound transmitting section so that the conventional television, when placed on the shelf, can be heard while reclining on the bed.

22. The canopy according to claim 21, wherein the (a) the front wall of the supporting apparatus further comprises a top edge; and (b) the horizontal platform further comprises a recessed planar member located parallel to the shelf and within the opening of the horizontal platform and further extending from the horizontal platform to the top edge of the front wall.

23. A canopy, for use with a bed, comprising:

(a) a horizontal platform having an opening;

(b) at least one upper side rail surrounding the periphery of said horizontal platform and extending substantially over the entire surface of the bed;

(c) at least three posts that support the horizontal platform in a location above the bed; and (d) a supporting apparatus located within the opening of the platform and attached to the platform; the supporting apparatus having the capability of supporting a conventional television set, having a front screen area, so that the top of the front screen area is above the horizontal platform and the opening is configured so that the upper portion of the screen is visually accessible to a viewer who is reclining or sitting on the bed.

24. The canopy according to claim 23, wherein the horizontal platform further comprises side rails located along substantially the entire periphery of the horizontal platform.

25. The canopy according to claim 23 that further comprises suitable wiring so that video, audio and a power source can be provided to the television placed on the shelf.

26. The canopy according to claim 23, wherein the supporting apparatus comprises:

(a) a shelf, two side walls, a back wall and a front wall;

(b) the front wall comprising:

(1) a transparent section so that the conventional television, when place don the shelf, can be viewed when reclining on the bed; and (2) a sound transmitting section so that the conventional television, when placed on the shelf, can be heard while reclining on the bed.

* * * * *

UNITED STATES PATENT AND TRADEMARK OFFICE

CERTIFICATE OF CORRECTION

PATENT NO. : 5,459,893

DATED : October 24, 1995

INVENTOR(S) : Guy A. Walters, III

It is certified that error appears in the above-indentified patent and that said Letters Patent is hereby corrected as shown below:

On the title page, item [73]: Assignee is misspelled and a word has been omitted, and should be corrected to --Thomasville Furniture Industries, Inc.--

The "Attorney, Agent or Firm" is misspelled, and should read: "Rhodes, Coats & Bennett." There is no "e" in Coats.

Signed and Sealed this

Twenty-first Day of May, 1996

*Attest:*

Bruce Lehman

BRUCE LEHMAN

*Attesting Officer*

*Commissioner of Patents and Trademarks*